US006155882A

United States Patent [19]

Wu

[11] Patent Number: 6,155,882

[45] Date of Patent: Dec. 5, 2000

[54] COLLAPSIBLE SOCKET CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/318,223

[22] Filed: May 25, 1999

[30] Foreign Application Priority Data

Nov. 20, 1998 [TW] Taiwan ..... 87119236

[51] Int. Cl.[7] ..... H01R 23/02

[52] U.S. Cl. ..... 439/676; 439/142

[58] Field of Search ..... 439/142, 676, 439/946, 144, 344, 345, 340

[56] References Cited

U.S. PATENT DOCUMENTS 5,415,566 5/1995 Brunker et al. ..... 439/608

5,501,607 3/1996 Yoshioka et al. ..... 439/142

5,679,013 10/1997 Matsunaga et al. ..... 439/144

5,702,271 12/1997 Steinman ..... 439/676

*Primary Examiner*—Brian Sircus

*Assistant Examiner*—Son V. Nguyen

*Attorney, Agent, or Firm*—Wei Te Chung

[57] ABSTRACT

A collapsible socket connector includes a base retaining a plurality of contacts therein and a cover pivotally attached to the base and movable with respect thereto between a closed position where the cover shields the contacts and an open position where the contacts are exposed and a space is defined between the base and the cover for receiving a mating plug connector therein whereby the contacts electrically engage with conductive elements of the plug connector.

8 Claims, 5 Drawing Sheets

COLLAPSIBLE SOCKET CONNECTOR

BACKGROUND OF THE INVENTION

1. Field of the Invention

The present invention generally relates to a socket connector, and in particular, to a collapsible socket connector for reducing the space occupied thereby when not in use.

2. The Prior Art

Electrical connectors are used to establish electrical connection between electronic devices and elements. The trend of miniaturization of the electronics industry requires an electronic product to accommodate a high density of connectors for providing expanded functions. Thus, an efficient use of space within the electronic product must be promoted. A collapsible structure provides an effective means to reduce the space occupied by a connector when the connector is not in use.

SUMMARY OF THE INVENTION

Accordingly, an object of the present invention is to provide a collapsible socket connector having a cover pivotally attached to a base whereby the cover is movable between a closed position and an open position for reducing the space occupied by the connector when not in use.

Another object of the present invention is to provide a collapsible socket connector having a cover pivotally attached to a base whereby the cover is movable between a closed position and an open position, contact elements being fully retained in the base at the closed position thereby protecting the contact elements from oxidation and corrosion.

A further object of the present invention is to provide a collapsible socket connector having a cover pivotally attached to a base whereby the cover is movable between a closed position and an open position, a space being defined between the cover and the base at the open position for receiving a plug connector whereby electrical connection may be established between the socket connector and the plug connector.

To achieve the above objects, a collapsible socket connector in accordance with the present invention comprises a base retaining a plurality of contacts therein and a cover pivotally attached to the base. The cover is movable with respect to the base between a closed position where the cover shields the contacts and an open position where the contacts are exposed and a space is defined between the base and the cover for receiving a mating plug connector therein whereby the contacts electrical engage with conductive elements of the plug connector.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF PREFERRED EMBODIMENTS

Figure 1:
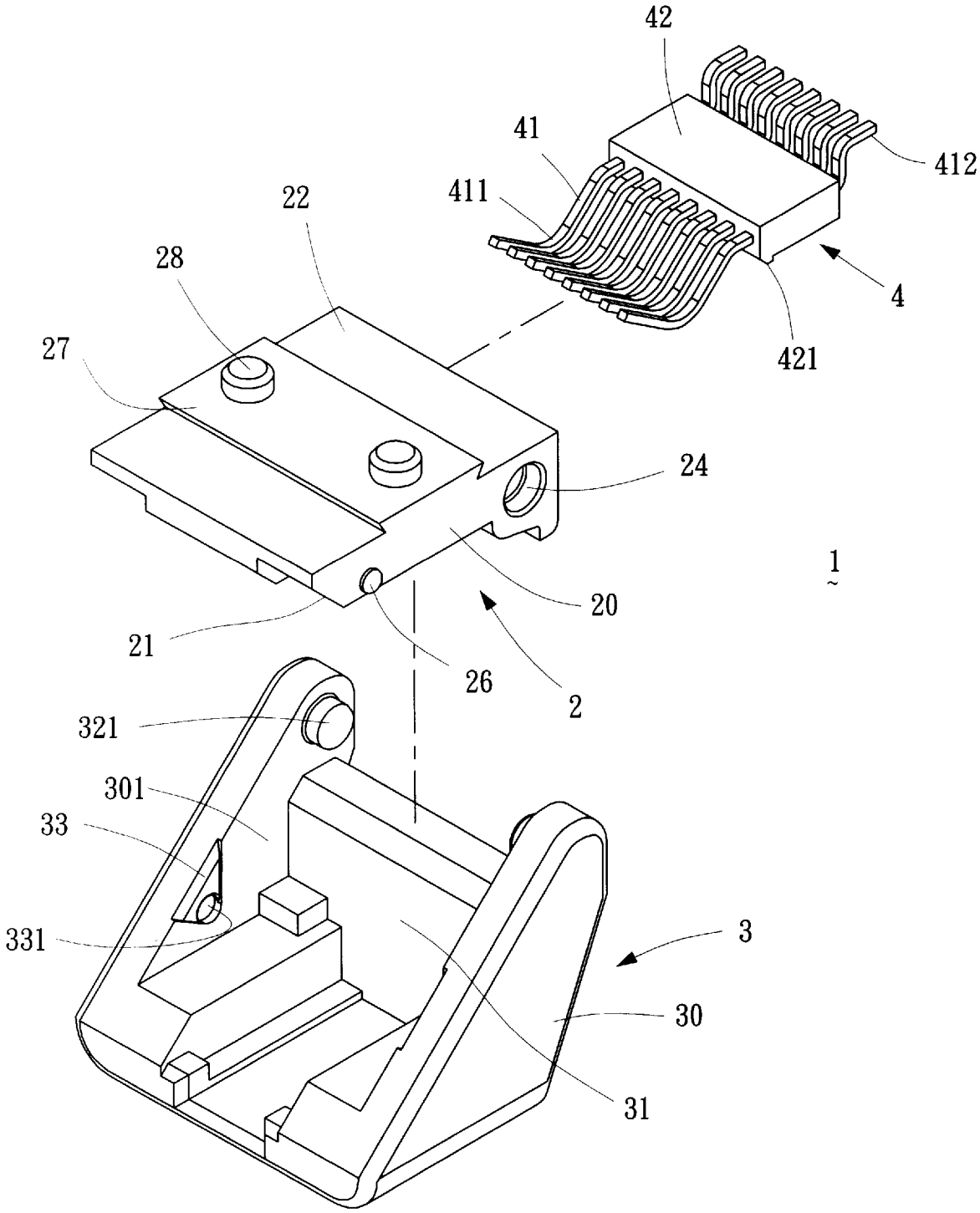
FIG. 1 is a bottom exploded view of a collapsible socket connector constructed in accordance with the present invention.
Figure 2:
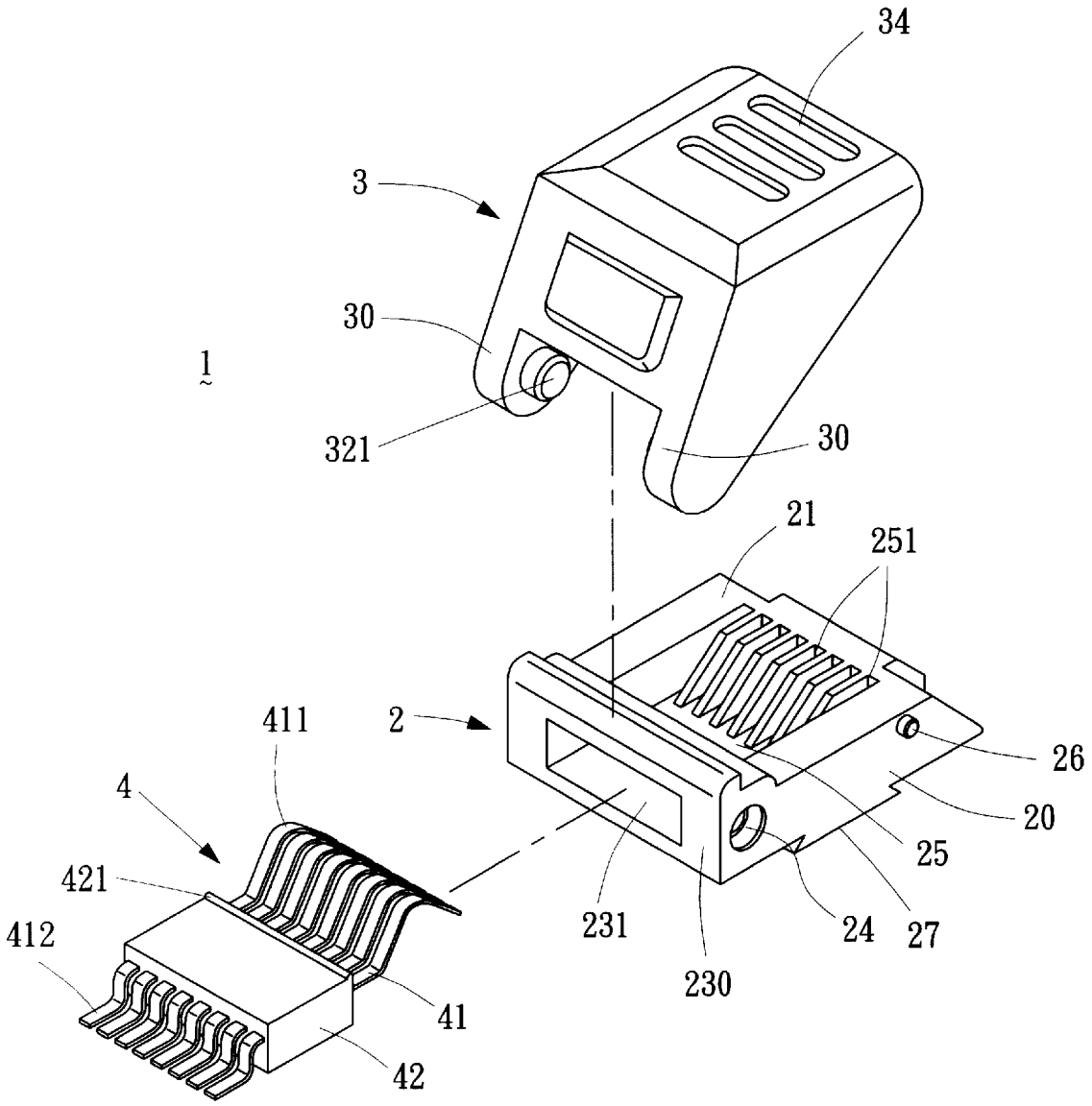
FIG. 2 is a top exploded view of the collapsible socket connector.

Referring to the drawings and in particular to FIGS. 1 and 2, a collapsible socket connector in accordance with the present invention comprises a base 2 defining a cavity 25 therein exposed to a top face 21 thereof. A plurality of channels 251 are formed in communication with the cavity 25. The base 2 has a rear wall 230 defining a slot 231 therein in communication with the cavity 25 for receiving a contact module 4.

Figure 4A:
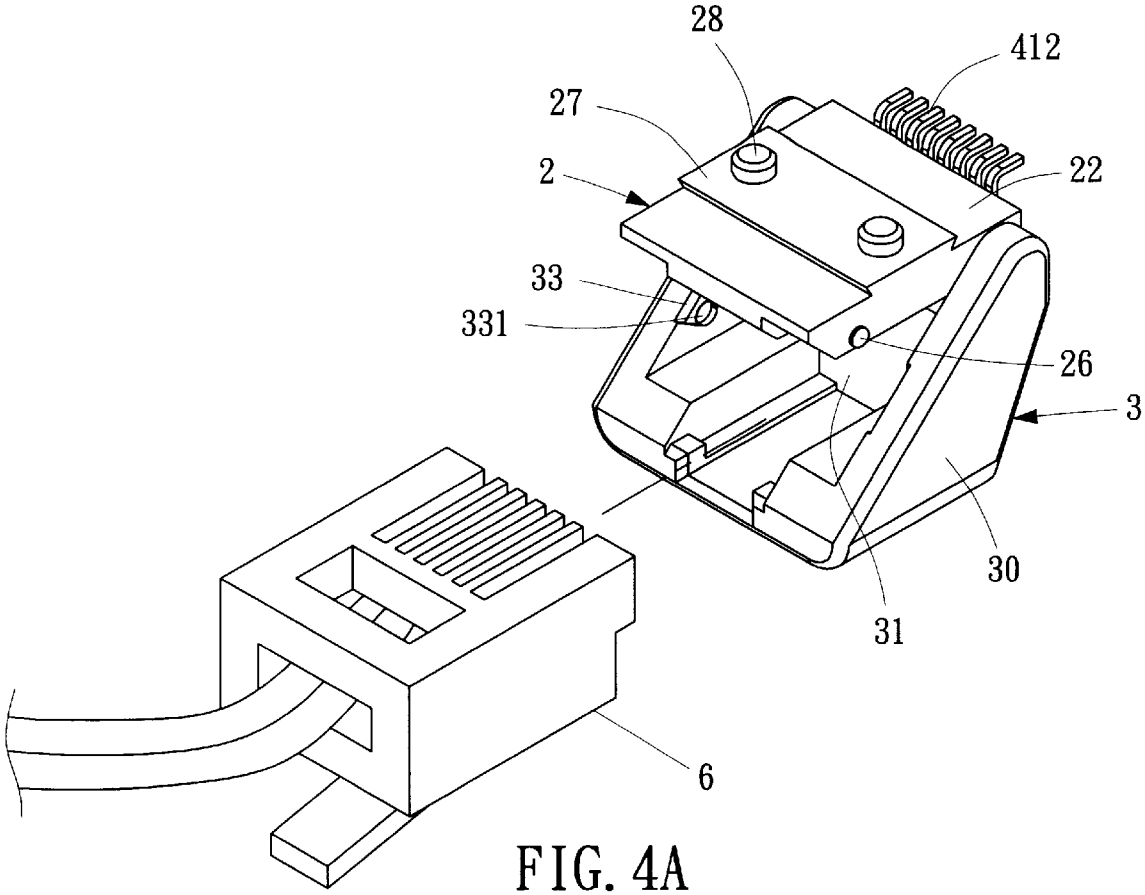
FIG. 4A is a perspective view of the collapsible socket connector at the open position before a mating plug connector engages therewith.
Figure 4B:
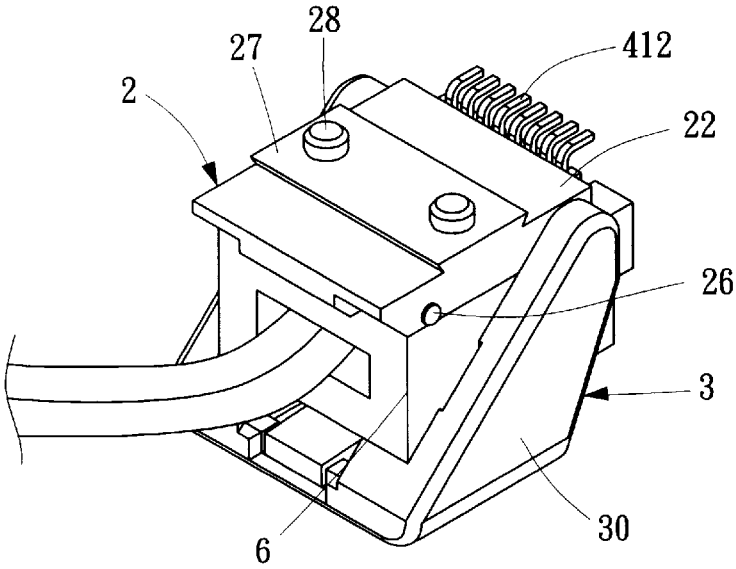
FIG. 4B is a perspective view of the collapsible socket connector after the plug connector engages therewith.

The contact module 4 comprises a number of contacts 41 fixed in a spacer 42. Each contact 41 has a mounting end section 412 and a mating end section 411 respectively extending beyond opposite faces of the spacer 42. The spacer 42 is inserted into the slot 231 and has a rib 421 engaging with an edge of an inner face of the cavity 25 for retaining the spacer 42 in the slot 231. The mating end sections 411 of the contacts 41 extend through the cavity 25 and are received in the channels 251. The mating end sections 411 form an arcuate portion for engaging with contacts (not shown) of a mating plug connector 6 (FIGS. 4A and 4B).

The base 2 defines a pair of pivot holes 24 therein exposed to opposite side faces 20 of the base 2. Each side face 21 also has a projection 26 formed thereon.

Figure 3A:
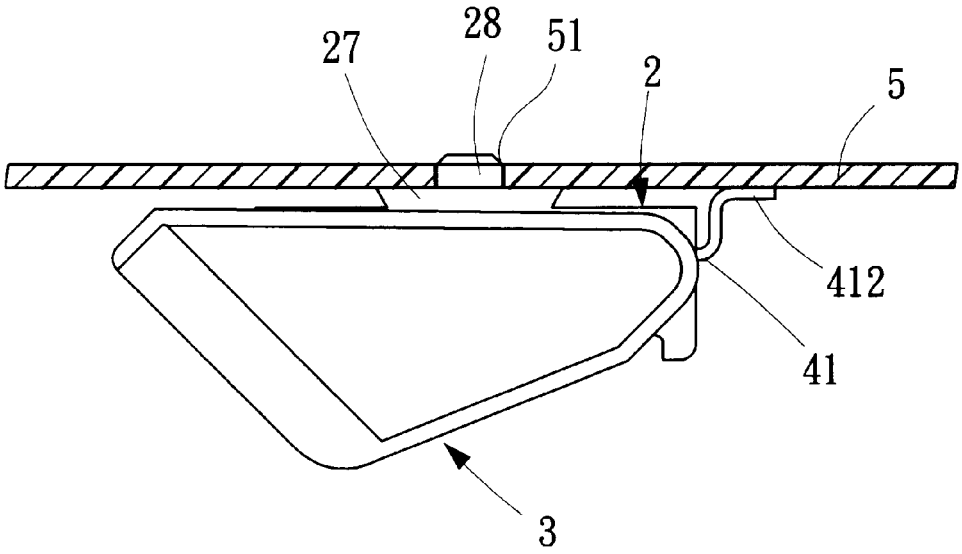
FIG. 3A is a side elevational view of the assembled collapsible socket connector mounted to a circuit board, the socket connector being at a closed position.
Figure 3B:
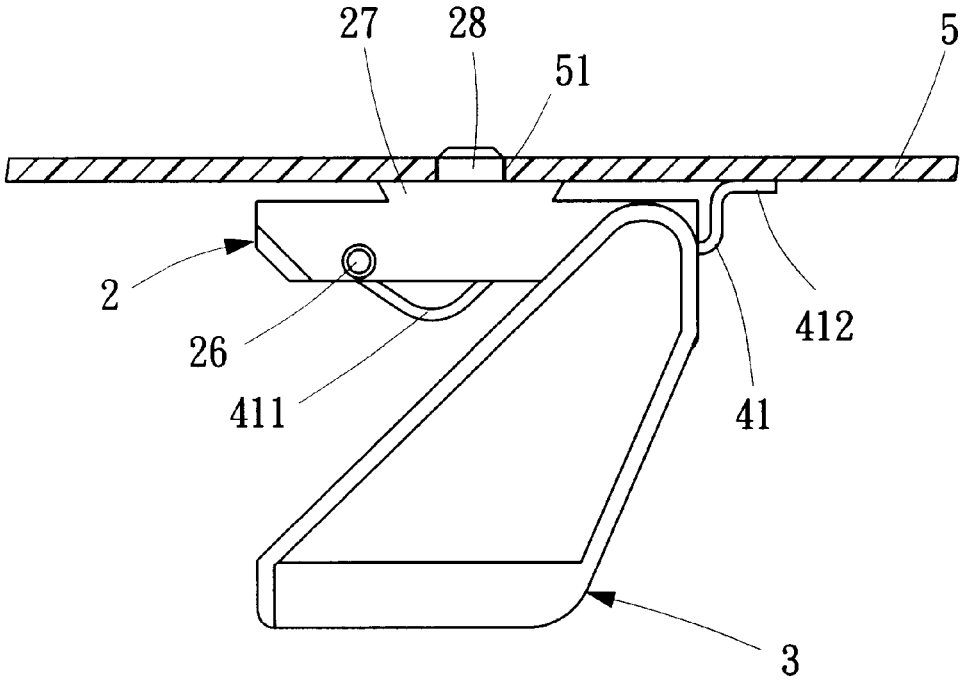
FIG. 3B is a side elevational view similar to FIG. 3A showing the socket connector at an open position.

A cover 3 comprises two spaced side walls 30 defining an interior space 31 therebetween. Each side wall 30 has an inside face 301 on which a trunnion 321 is formed extending into the interior space 31. The trunnions 321 are received in the corresponding pivot holes 24 of the base 2 thereby rendering the cover 3pivotable about the trunnions 321 with respect to the base 2 between a closed position (FIG. 3A) and an open position (FIG. 3B). The cover 3 may be provided with grooves 34 on an outer surface thereof for facilitating the manual pivotal movement of the cover 3.

At the closed position, the base 2 is received in the interior space 31 of the cover 3 whereby the base 2 and the mating end sections 411 of the contacts 41 are enclosed by the cover 3 and the interior space 31 of the cover 3 is enclosed by the base 2. At the open position, the cover 3 is pivoted away from the base 2 thereby exposing the mating end sections 411 of the contacts 4 and the interior space 31 of the cover 3. Referring to FIGS. 4A and 4B, a space is defined between the base 2 and the cover 3 at the open position and the space, including the interior space 31 of the cover 3, is large enough to receive the mating plug connector 6 thereby forming electrical engagement between the mating end sections 411 of the contacts 41 and the contacts of the mating connector 6.

The collapsible structure of the socket connector 1 of the present invention allows the socket connector 1 to occupy a smaller amount of space when the plug connector 6 is removed and the socket connector 1 is not in use. Thus, an efficient use of space is promoted within an electronic device in which the connector is mounted. Furthermore, by closing the cover 3 after the plug connector 6 is removed, the contacts 41 are shielded and separated from the external environment thereby protecting the contacts 41 from oxidation and corrosion.

Each side wall 30 of the cover 3 defines a hole 331 therein exposed to the inside face 301 thereof. The holes 331 corresponds to the projections 26 of the base 2 and snappingly engage therewith for retaining the cover 3 at the closed position with respect to the base 2. Preferably, a recess 33 is defined on the inside face 301 of each side wall 30 and the hole 331 is defined in the recess 33.

The base 2 has a bottom face 22 on which two positioning pins 28 are formed. The positioning pins 28 are inserted into holes 51 defined in a circuit board 5 for properly positioning the connector 1 on the circuit board 5 as shown in FIGS. 3A and 3B. The base 2 is positioned on the circuit board 5 whereby the mounting end sections 412 of the contacts 41 electrically engage with the circuit board 5.

Figure 5:
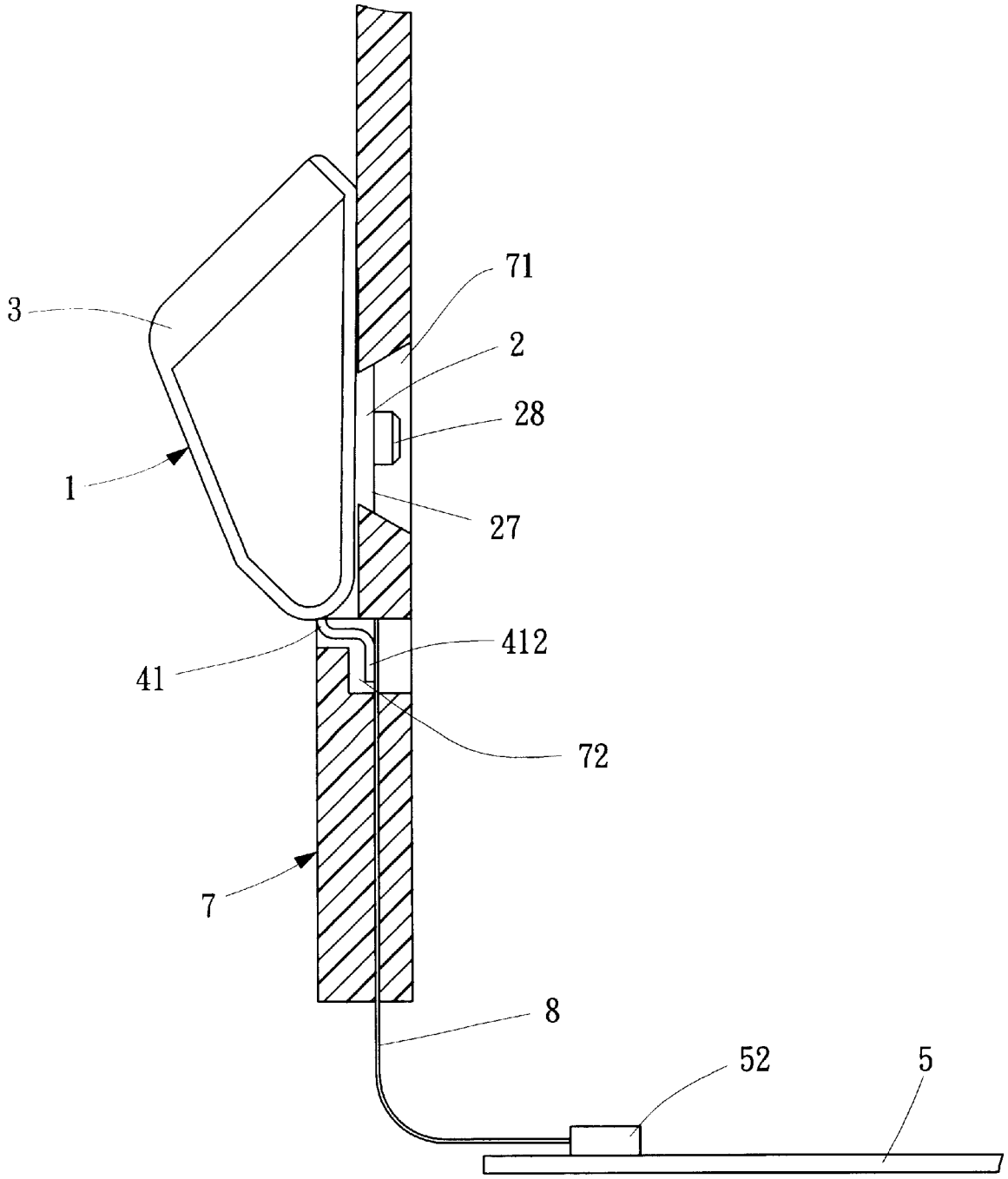
FIG. 5 is a side elevational view of the collapsible socket connector mounted to a casing of an electronic device.

Referring to FIG. 5, the base 2 further comprises a dovetailed tenon 27 engageable with a dovetailed mortise 71 defined in a casing 7 of an electronic device for fixing the connector 1 to the casing 7. The casing 7 may further define a recess 72 for accommodating the mounting end sections 412 of the contacts 41 therein. Wires or a flexible printed circuit board 8 extend into the recess 72 for electrically engaging with the mounting end sections 412 of the contacts 41 and connecting the connector 1 to the printed circuit board 5 via another connector 52 mounted on the circuit board 5.

Although the present invention has been described with reference to a preferred embodiment, it is apparent to those skilled in the art that a variety of modifications and changes may be made without departing from the scope of the present invention which is intended to be defined by the appended claims.

What is claimed is:

1. An expandable socket connector comprising a first section and a second section movable relative to said first section, a plurality of electrical contacts disposed within said first section, wherein the first and second sections are pivotally movable relative to each other between a closed position where the first and second sections are closed to each other for protectively shielding the contacts and an open position where the first and second sections are spaced from and substantially parallel to each other for forming a receiving channel extending in a direction substantially parallel to the first and second sections receiving a mating connector with the mating connector being guided, supported and retained by both the first and second sections to electrically engage the contacts, and wherein the first section defines a cavity therein bound by a rear wall, a slot being defined in the rear wall in communication with the cavity, the contacts being retained in a spacer, the spacer being inserted into the slot with end portions of the contacts extending into the cavity for electrically engaging with the mating connector.

2. The socket as claimed in claim 1, wherein releasable retaining means is provided between the first and second sections for releasably retaining the first and second sections at the closed position.

3. The socket as claimed in claim 2, wherein the releasable retaining means comprises a hole defined in the first section and a projection formed on the second section snappingly engaging with the hole.

4. The socket as claimed in claim 1, wherein the first section has an outside surface on which positioning pins are formed and being inserted into holes defined in a circuit board for properly positioning the socket on the circuit board.

5. The socket as claimed in claim 1, wherein the first section has an outside surface on which a dovetailed tenon is formed and engaging with a dovetailed mortise defined in a casing of an electronic device for fixing the socket to the casing.

6. The socket as claimed in claim 1, wherein said second section is connected to said first section.

7. The socket as claimed in 6, wherein said second section is pivotally attached to said first section.

8. The socket as claimed in claim 7, wherein the first section defines pivot holes for pivotally receiving corresponding trunnions formed on the second section therein.

* * * * *